US006105499A

United States Patent [19]

Helmstädter et al.

[11] Patent Number: 6,105,499

[45] Date of Patent: Aug. 22, 2000

[54] TRANSPORT DRUM IN ROTARY PRINTING PRESSES

[75] Inventors: Karl-Heinz Helmstädter, Sinsheim; Raimund Schröder, Hockenheim, both of Germany

[73] Assignee: Heidelberger Druckmaschinen AG, Heidelberg, Germany

[21] Appl. No.: 09/174,295

[22] Filed: Oct. 16, 1998

[30] Foreign Application Priority Data

Oct. 16, 1997 [DE] Germany ..... 197 45 763

[51] Int. Cl.[7] ..... B41F 1/28

[52] U.S. Cl. ..... 101/422; 101/416.1

[58] Field of Search ..... 101/416.1–421, 101/422, 217

[56] References Cited

U.S. PATENT DOCUMENTS

| | | | |
|---|---|---|---|
| 3,308,522 | 3/1967 | Miller | 226/190 |
| 4,833,984 | 5/1989 | Bolza-Schunemann et al. | 101/220 |
| 5,000,437 | 3/1991 | Schneider et al. | 271/187 |
| 5,397,651 | 3/1995 | Wirz | 428/600 |
| 5,511,480 | 4/1996 | DeMoore et al. | 101/492 |
| 5,603,264 | 2/1997 | DeMoore et al. | 101/483 |

FOREIGN PATENT DOCUMENTS

| | | |
|---|---|---|
| 0 036 937 A1 | 10/1981 | European Pat. Off. . |
| 0 417 497 A2 | 3/1991 | European Pat. Off. . |
| 0 723 865 A1 | 7/1996 | European Pat. Off. . |
| 39 39 479 A1 | 4/1991 | Germany . |

*Primary Examiner*—John S. Hilten
*Assistant Examiner*—Dave A. Ghatt
*Attorney, Agent, or Firm*—Herbert L. Lerner; Laurence A. Greenberg; Werner H. Stemer

[57] ABSTRACT

A transport drum in a rotary printing press, having a covering for preventing a fresh printed product from being smeared when the printed product is being transported through the press, the covering being secured to the jacket surface of the transport drum and being formed of a carrier material, includes resiliently embodied filamentary support elements secured in the carrier material of the covering, and an ink-repellent material applied to outer ends, respectively, of the support elements.

9 Claims, 1 Drawing Sheet

Fig.1
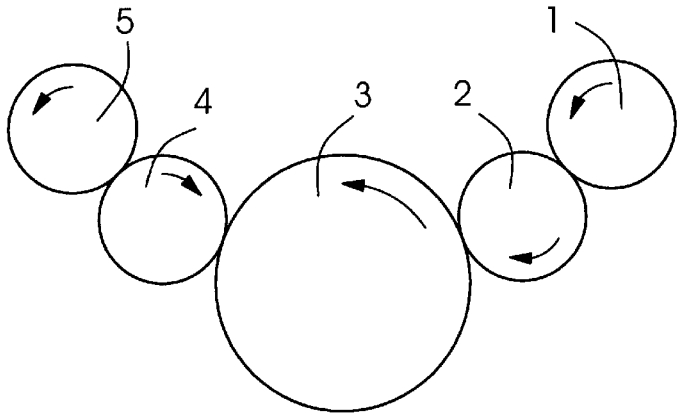
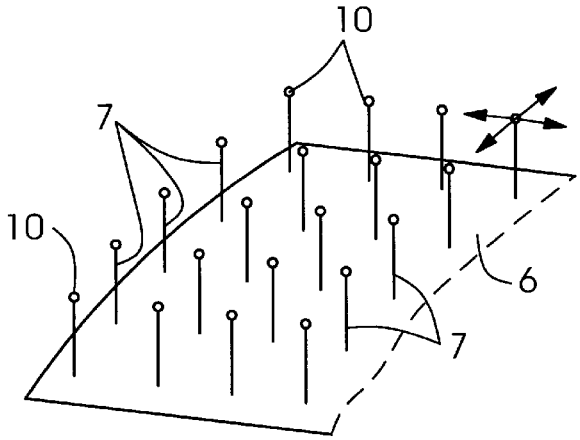
Fig.2
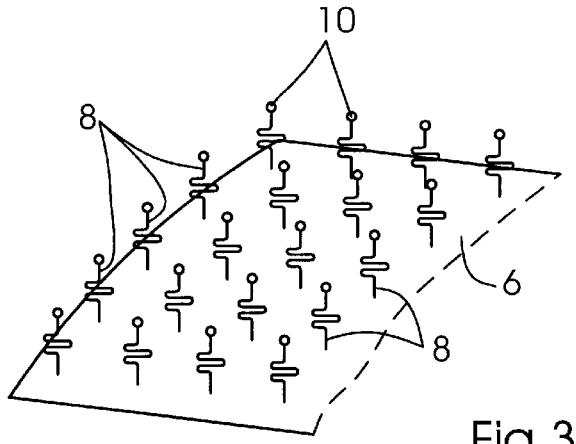
Fig.3
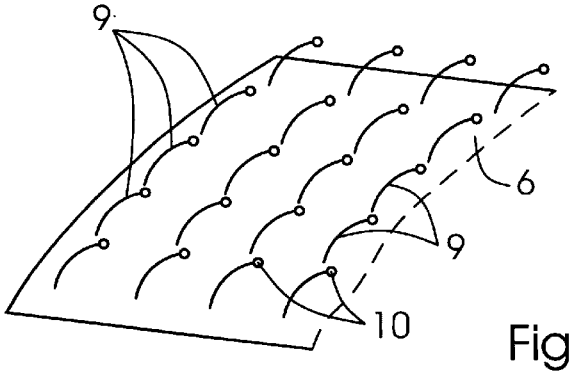
Fig.4

TRANSPORT DRUM IN ROTARY PRINTING PRESSES

BACKGROUND OF THE INVENTION

Field of the Invention

The invention relates to a transport drum in rotary printing presses, having a covering to prevent smearing of a fresh printed product when the printed product is being transported through the press, the covering being secured to the jacket surface of the transport drum and being formed of a carrier material with filamentary support elements secured therein.

From the published German Patent Document DE 14 71 728 B, a guide roller or impression roller having such a covering has become known heretofore, the filamentary support elements thereof extending vertically away from the covering, and being formed of a flexible polyamide. It has been found that these somewhat pointed filamentary support elements can dig into the fresh printing ink and damage the surface thereat. Ink particles can also be removed and deposited disruptively in other regions of the printed image. The embodiment of the support elements in the form of loops, shown as an alternative in this German reference, entails greater production expense, especially if the individual loops are intended to have a like height relative to the jacket surface of the drum.

In another heretofore known version of a covering on a transport drum, as shown in the published European Patent Document EP 0 036 937 B1, a body fabric is used that carries the freshly printed products. In this embodiment, as well, ink absorption by the covering cannot be precluded, so that it is necessary to clean the covering at given intervals of time. If the cleaning is performed in the printing press, the rubbed-off ink residues may then soil other press parts and cause printing problems.

Proceeding from this state of the prior art, it is an object of the invention of the instant application to provide a transport drum in rotary printing presses which is of such construction as largely to prevent smearing or deposition of ink particles on the support elements of the covering, so as to avert impairment of a freshly printed image on a printed product.

SUMMARY OF THE INVENTION

With the foregoing and other objects in view, there is provided, in accordance with the invention, a transport drum in a rotary printing press, having a covering for preventing a fresh printed product from being smeared when the printed product is being transported through the press, the covering being secured to the jacket surface of the transport drum and being formed of a carrier material, comprising resiliently embodied filamentary support elements secured in the carrier material of the covering, and an ink-repellent material applied to outer ends, respectively, of the support elements.

In accordance with another feature of the invention, the ink-repellent material is a slight quantity of chromium.

In accordance with a further feature of the invention, the support elements are disposed obliquely in the carrier material.

In accordance with an added feature of the invention, the support elements are resiliently constructed radially to the transport drum.

In accordance with a concomitant feature of the invention, the carrier material has a spring-elastic construction.

Because the support elements are embodied resiliently, they can follow a relative motion of the printed product on the transport drum without any relative motion occurring between the drum and the printed product itself. Once the printed product has left the transport drum, the individual support elements return resiliently to the initial position thereof. The application of an ink-repellent material to the respective outer ends of the support elements prevents ink particles from being transferred and thus also prevents damage to the printed image. Moreover, the bearing or contact area for the printed product is thereby increased, thus once again preventing the support elements from penetrating into the printing ink. Nevertheless, very small bearing or contact locations for the printed product are created, thereby assuring damage-free transport of the product.

In an advantageous construction of the invention, a slight quantity of chromium is applied to the outer ends of the support elements. Chromium is an ink-repellent material which offers an additional advantage that the support elements have high wear resistance.

In another advantageous construction of the invention, the support elements are disposed obliquely in the base or carrier material, so that, depending upon the material of the support elements, high resilience of the latter is achieved.

Another advantageous construction of the invention calls for the support elements to be embodied resiliently radially to the transport drum. The resilient embodiment of the support elements may, for example, be loop-formed or spiral-formed. Forming the base or carrier material so that it is spring-elastic ensures an even further improvement over the spring action of the support elements, so that a relatively stiff material may also be used for the support elements. This provision also allows the support elements to rebound not only in the circumferential and longitudinal direction of the transport drum, but also in the radial direction as well, which improves the unwinding of the printed products from the transport drums and reliably prevents the printed products from being smeared.

Other features which are considered as characteristic for the invention are set forth in the appended claims.

Although the invention is illustrated and described herein as embodied in a transport drum in rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 1 is highly diagrammatic, side elevational view of transport drums in a printing press;

FIG. 2 is a fragmentary perspective view of a covering or packing for one of the transport drums, having resilient support elements, respectively, secured at one end thereto and provided with ink-repellent material at the other or outer end thereof;

FIG. 3 is a view like that of FIG. 2, of another embodiment of the support elements carrying ink-repellent material at the free ends thereof, this embodiment of the support elements being constructed so as to be radially resilient; and FIG. 4 is a view like those of FIGS. 2 and 3 of another embodiment of the support elements carrying ink-repellent material according to the invention, this embodiment of the support elements being disposed obliquely in the base or carrier material of the covering or packing.

DESCRIPTION OF THE PREFERRED EMBODIMENTS

Referring now to the drawing and, first, particularly to FIG. 1 thereof, there is shown quite diagrammatically therein a rotary printing press wherein a printed product is transferred from an impression cylinder 1 via three transport drums 2, 3 and 4 to a next impression cylinder 5. The printed product, which is printed in one color, passes from the impression cylinder 1 onto the transport drum 2, where it lies with the fresh ink facing inwardly on this transport drum 2. The printed product is then transferred to the transport drum 3, so that the fresh printing ink comes to rest facing outwardly, and then passes onto the transport drum 4, again with the fresh printing ink thereon facing inwardly. From the transport drum 4, the printed product is transferred to the next impression cylinder 5, whereat the next color is printed thereon. Accordingly, a covering or packing to prevent the fresh printing ink from smearing as the printed products are transported through the printing press is required on the transport drums 2 and 4. The covering or packing is secured to the jacket surface of the respective transport drum 2, 4 and is made up of a base or carrier material 6, with flexible filamentary support elements 7, 8, 9, secured at one end, respectively, therein.

The support elements 7, 8, 9 are embodied resiliently and, as shown in FIG. 2, are disposed radially to the base or carrier material. As indicated by arrows in FIG. 2, they can rebound reiliently in all directions, and return to the initial position thereof again after the printed product has been transported. At the respective outer ends of the support elements 7, 8, 9, ink-repellent caps 10 are applied to the support elements 7, 8, 9, the caps 10 being preferably formed of chromium and being secured by electroplating. The ink-repellent material is applied in small quantities and, as it is applied, assumes an approximately spherical shape.

In FIG. 3, the support elements 8 that are illustrated are constructed so as to be resilient radially to the transport drum 2, 4. The support elements 8 may be loop-formed or spiral-formed, to achieve a high spring action.

The support elements 9 of FIG. 4 are disposed obliquely in the base or carrier material 6, so that once again a high spring action radially to the transport drum 2, 4 is attained. At the same time, the support elements 9 are capable of moving relative to the base or carrier material 6 so that damage to the printed image is precluded.

We claim:

1. A transport drum in a rotary printing press, comprising:

a transport drum;

a jacket surface disposed on said transport drum;

a covering for preventing a fresh printed product from being smeared when the printed product is being transported through the press, said covering being secured to said jacket surface of said transport drum and being formed of a carrier material;

a plurality of filamentary support elements, each one of said plurality of support elements having an inner end secured in said carrier material of said covering, and having an outer end remote from said inner end: and an ink-repellent material attached to said outer end of each one of said plurality of support elements.

2. The transport drum according to claim 1, wherein said ink-repellent material is a slight quantity of chromium.

3. The transport drum according to claim 1, wherein said carrier material defines a surface and said plurality of support elements extend obliquely with respect to said surface of said carrier material.

4. The transport drum according to claim 1, wherein said plurality of support elements are resilient.

5. The transport drum according to claim 1, wherein said carrier material has a spring-elastic construction.

6. The transport drum according to claim 1, wherein said plurality of support elements are resiliently deformable in a radial direction with respect to an axis of rotation of the transport drum.

7. The transport drum according to claim 1, wherein said plurality of support elements are bristle-shaped.

8. The transport drum according to claim 1, wherein said plurality of support elements are spiral-shaped.

9. The transport drum according to claim 1, wherein said plurality of support elements are curved.

* * * * *